US008186339B1

(12) United States Patent
McClanahan

(10) Patent No.: US 8,186,339 B1
(45) Date of Patent: May 29, 2012

(54) ARCHERY BOW SHOT COVER DEVICE

(76) Inventor: Terry Gerard McClanahan, Chicora, PA (US)

( * ) Notice: Subject to any disclaimer, the term of this patent is extended or adjusted under 35 U.S.C. 154(b) by 494 days.

(21) Appl. No.: 12/322,302

(22) Filed: Feb. 2, 2009

(51) Int. Cl.
*F41B 5/14* (2006.01)

(52) U.S. Cl. ..... 124/86; 446/404

(58) Field of Classification Search ..... 124/86, 124/88; 446/397, 404; 367/139
See application file for complete search history.

(56) References Cited

U.S. PATENT DOCUMENTS 5,802,197 A * 9/1998 Fulcher ..... 381/386
5,964,054 A * 10/1999 Galfidi, Jr. ..... 42/90
6,155,244 A 12/2000 McClanahan
6,359,549 B1 * 3/2002 Lau et al. ..... 340/384.71
6,414,906 B1 * 7/2002 Gaspari ..... 367/139
7,133,528 B2 * 11/2006 Stilwell ..... 381/61
7,324,408 B2 * 1/2008 Cilliers ..... 367/139
7,337,773 B2 * 3/2008 Simo et al. ..... 124/44.5

* cited by examiner

*Primary Examiner* — John Ricci
(74) *Attorney, Agent, or Firm* — Aileen Champion Addessi

(57) ABSTRACT

An archery bow shot cover device is attachable to an archery bow for use during hunting an animal. The archery bow shot cover device includes a housing, a sensor, a memory chip and a speaker. During use, a sensor detects the release of an arrow from the archery bow, which triggers a memory chip to send a signal carrying an animal sound to the speaker. The animal sound is emanated from the speaker and covers up or camouflages the noise produced by the release of the arrow from the bow. The sensor may be an accelerometer or other vibration type of switch, a motion detector, a bar code type of reader, or other type of sensor for detecting the release of the arrow from the archery bow. The device includes a USB port or jack for installing additional natural animal sounds or other types of sounds onto the device.

20 Claims, 4 Drawing Sheets

ARCHERY BOW SHOT COVER DEVICE

BACKGROUND OF THE INVENTION

The invention relates to archery bows and, more particularly, to a device for covering up the noise emanating from a bow when an arrow is shot therefrom.

While hunting with a bow for deer or other big game species, the animals can hear the vibrating thud or slapping noise made by the bow when an arrow is released from the bow. This noise can scare the animal and cause the animal to move, often resulting in a bad hit, which injures the animal, or misses the animal.

There are several kinds of devices which attempt to reduce this problem. One such device is a bow silencer which reduces the vibration of the string and the slap of the bow components against one another. A silencer is disclosed in U.S. Pat. No. 4,628,892 entitled "Bow and String Silencer". This device is attached to the bow for reducing the noise made by the bow when the string of the bow is released.

Other alternatives to overcome the noise produced during the release of the arrow include using a soft material for an arrow rest, using a lubricating powder on the arrow rest, using a silicone spray to protect and keep surfaces slippery, and using sleeves over the arrow rest surfaces.

However, use of these alternatives does not totally eliminate the noise produced by the bow when the arrow is released, but only reduces the noise. Often, the deer or other animal can still be spooked by the reduced noise.

U.S. Pat. No. 6,155,244 to McClanahan and entitled "Archery Bow Shot Cover Device" discloses a device that produces a natural animal sound for covering up the noise produced by the bow when the arrow is released.

Therefore, what is needed is an apparatus for covering up the noise produced by the bow when the arrow is released which utilizes a sound mechanism capable of generating numerous natural animal sounds corresponding to the type of animal to be hunted.

SUMMARY OF THE INVENTION

An archery device for attachment to an archery bow having an arrow includes a sensor positionable on the archery bow for detecting a release of the arrow from the archery bow, and a sound mechanism coupled to the sensor for producing at least one sound. The sound mechanism is activated by the sensor for producing the at least one sound when the arrow is released from the archery bow for covering up noise emanating from the archery bow when the arrow is shot from the bow.

The archery device may further include a housing attachable to the archery bow, and having the sensor and sound mechanism positioned within the housing. The sound mechanism includes a speaker for emanating one of the at least one sound therefrom, and a memory chip coupled to the sensor for storing the at least one sound in the archery device. The sensor may be a vibration detector, such as an accelerometer, a motion detector, a beam of light, a bar code reader, or the like.

Additional features of the archery device include a USB port or jack positioned in the housing for transferring sounds from a remote location to the sound mechanism, an LED light electrically coupled to the sound mechanism for illuminating light upon activation for indicating a modification in a type of sound to be produced by the sound mechanism, a plurality of buttons positioned on the housing for controlling operation of the archery device, such as a sound select button coupled to the sound mechanism for scrolling through the at least one sound to select a desired sound, an on/off switch, volume switches, or the like.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
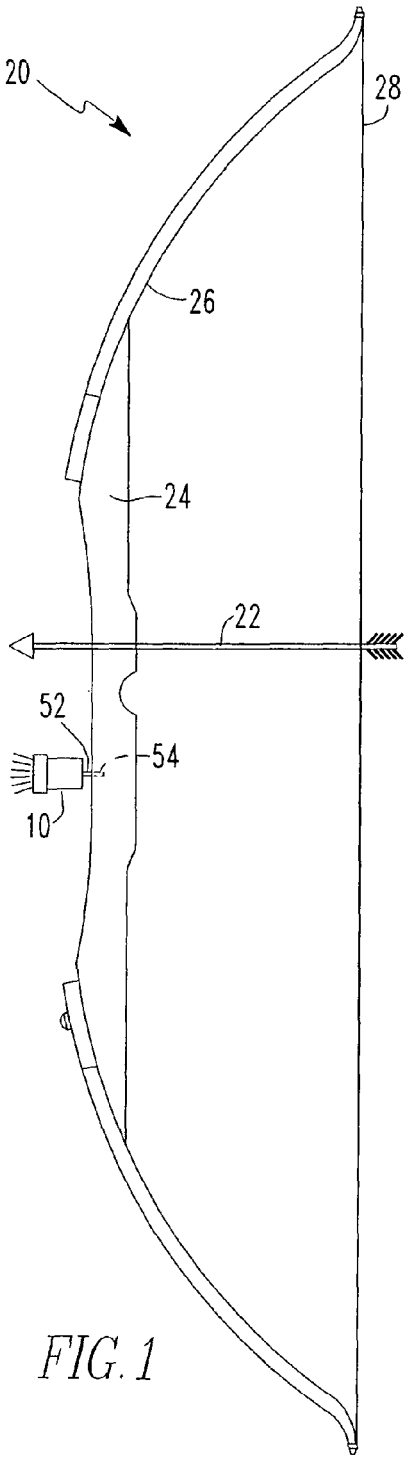
FIG. 1 is a schematic illustration of a recurve bow having an archery bow shot cover device attached thereto.
Figure 2:
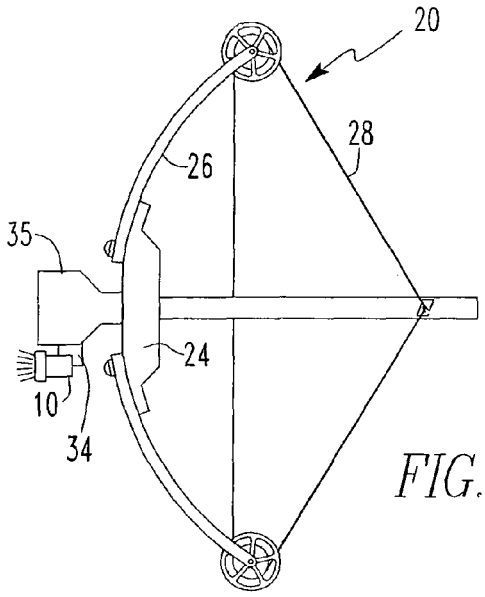
FIG. 2 is a schematic illustration of a cross bow having the archery bow shot cover device attached thereto.
Figure 3:
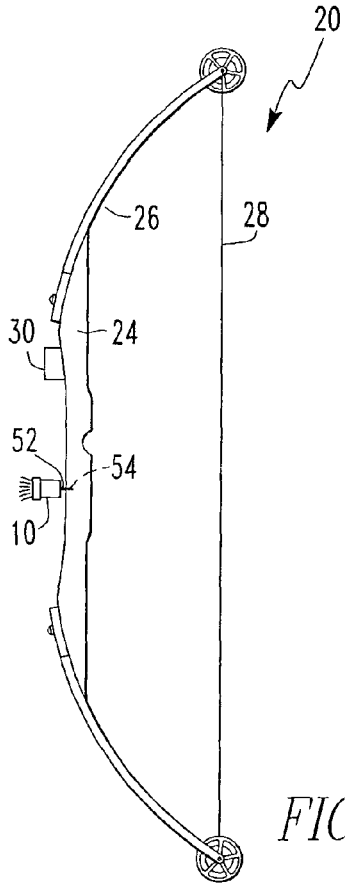
FIG. 3 is a schematic illustration of a compound bow having the archery bow shot cover device attached thereto.

An archery bow shot cover device 10 may be attached to various types of archery bows 20, such as a compound bow as illustrated in FIG. 1, a recurve bow as illustrated in FIG. 2, a cross bow as illustrated in FIG. 3, or the like. An arrow 22 can be shot from the archery bow 20. Each type of archery bow 20 typically includes a handle or bow riser 24, a limb 26 extending from each end of the handle 24, and a string 28 attached to each outer end of the limbs 26. The archery bow shot cover device 10 may be attached at various positions on different types of bows, such as to the handle 24 of the bow, to a stabilizer (not shown) positioned on the handle 24 of the bow, to the limb 26 of the bow, to a sight bracket 30, or to any other component or accessory of the bow 20. The archery bow shot cover device 10 may be secured to the bow 20 mechanically, such as by an attachment member, a screw, a bolt, with a mounting bracket, or the like, adhesively, welded, or by any other suitable means.

Referring to FIGS. 1-3, the archery bow shot cover device 10 includes a housing 32 which is attached to the bow 20. In FIGS. 1 and 2, as an example, the housing 32 is secured to the handle 24 of the recurve and the compound bows. In FIG. 3, as another example, the housing 32 is secured to an extension 34, which is attached to a foot bracket 35 of the cross bow. The extension 34 is an accessory that may be used to position the housing 32 in a desired location on various types of bows.

Figure 4:
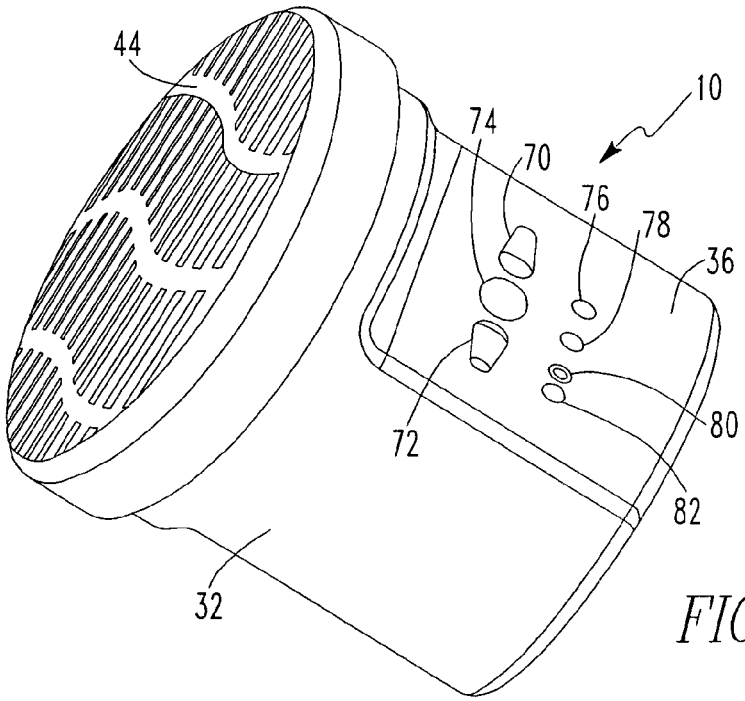
FIG. 4 is an isometric view of the archery bow shot cover device.
Figure 5:
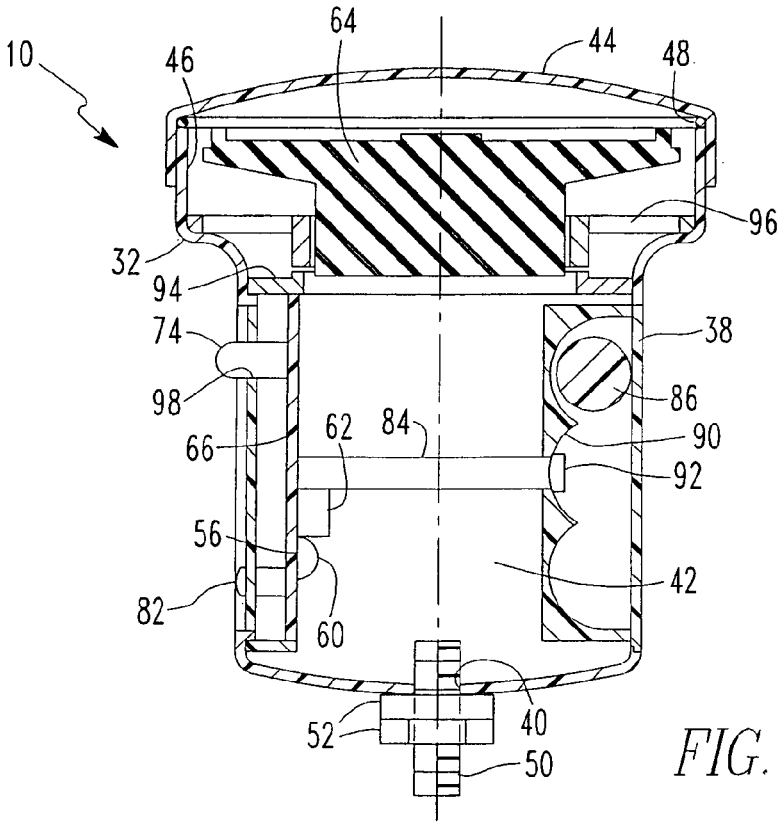
FIG. 5 is a cross-sectional view of the archery bow shot cover device.
Figure 6:
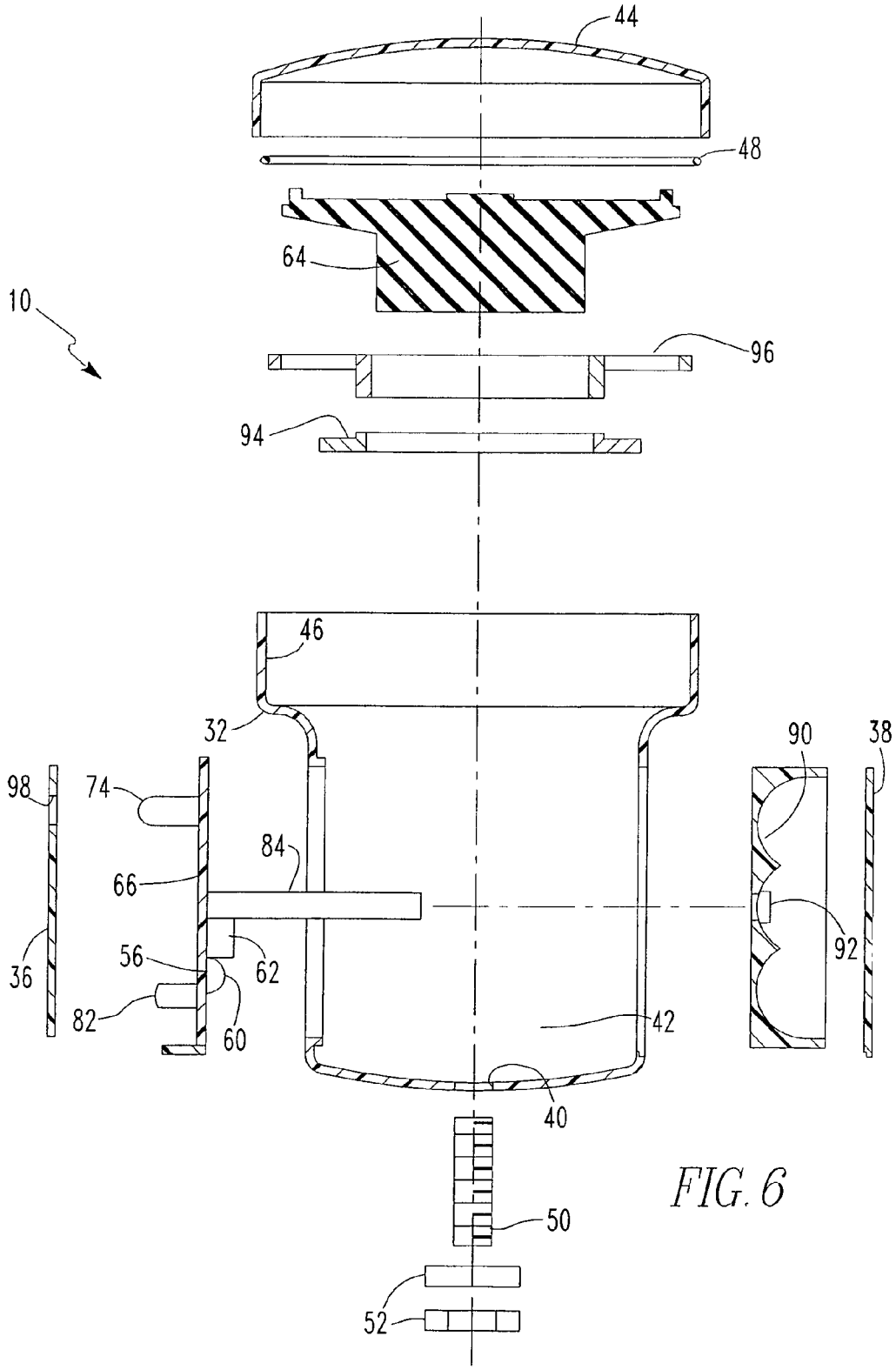
FIG. 6 is an exploded view of the archery bow shot cover device.

Referring to FIGS. 4-6, the housing 32 includes a shell having a button panel 36, a battery lid 38, a threaded hole 40, and a cavity 42. A grill 44 having a plurality of openings encloses an open end 46 of the shell. An O-ring 48 is positioned between the grill 44 and the housing 32 for sealing the components of the archery bow shot cover device 10 within the housing 32. Several components of the archery bow shot cover device 10 are housed within the cavity 42 of the housing 32. The housing 32 is attached to the bow 20, such as by using a bolt 50 and at least one nut 52, for threadedly securing the housing 32 through the threaded hole 40 to an existing threaded hole 54 in the bow. Alternatively, the housing 32 may be attached adhesively, mechanically, or by any other suitable type of method for securing the housing 32 to the bow 20. The housing 32 may be constructed of plastic or another type of lightweight material.

The archery bow shot cover device 10 includes a sensor 56 for detecting the release of the arrow 22 from the bow 20. The sensor 56 may be electronic, mechanical, or combinations thereof. For example, the sensor 56 may be a vibration switch or sensor, a motion detector, a bar code type of reader, a light beam, or any other suitable type of detector or sensor.

Referring to FIGS. 5 and 6, an example of the sensor 56 is an accelerometer 60 that is positioned with the housing 32. The accelerometer 60 is a vibration switch or sensor that is used to detect the vibration of the bow 20. As the arrow 22 is released from the bow 20, the bow 20 vibrates. The vibration of the bow 20 during the release of the arrow 22 triggers the accelerometer 60, which produces a signal.

The archery bow shot cover device 10 also includes a sound mechanism for emitting a sound from the archery shot cover device 10. The sound mechanism may include a memory chip 62 and a speaker 64. The memory chip 62 is contained within the housing 32, and is capable of storing at least one sound. Preferably, the memory chip 62 has the capability of storing multiple sounds, such as natural animal sounds, nature sounds, or the like. The memory chip 62 is connected to the accelerometer 60 and receives the signal from the accelerometer 60.

The speaker 64 is also contained within the housing 32 of the archery bow shot cover device 10. The speaker 64 is connected to the memory chip 62. The memory chip 62 transfers the sound from the memory chip 62 to the speaker 64 for emitting the sound from the speaker 64.

The memory chip 62 is attached to a circuit board 66, which is positioned within the housing 32. The circuit board 66 includes electronic circuitry or controls for various functions, such as volume switches including a volume increase switch 70 and a volume decrease switch 72, a test switch 74, an on/off button 76, a sound select button 78, a jack 80, an LED light 82, and a USB port 84.

The volume switches 68 and 70, the test switch 74, the on/off button 76, the sound select button 78, the jack 80, and the LED light 82 are positioned on an outside surface or the button panel 36 of the housing 32, providing easy access or viewing for the operator of the archery bow shot cover device 10. The volume switches 70 and 72 are used by the operator for altering the volume of the sound emanating from the speaker 64. The test switch 74 is used by the operator for testing the archery bow shot cover device 10 to determine if the device 10 is on or off, to determine if the batteries are functioning properly, to determine if the correct sound is set, or to test for any other desired feature. The on/off switch 76 is for turning the archery bow shot cover device 10 on or off.

The sound select button 78 can be used by the operator to select various sounds from pre-installed sounds stored in the archery bow shot cover device 10. For example, the sounds may include natural animal sounds, such as a deer grunt, a doe bleat, an elk whistle, a turkey yelp, or any other desired type of sounds. By depressing the sound select button 78, the pre-installed sounds can be scrolled through until the desired sound to be used is selected.

The jack 80 can be used to plug accessories into the archery bow shot cover device 10. The jack 80 can be used to connect a cable from the archery bow shot cover device 10 to a computer (not shown). A cable connection to a computer would enable additional sounds to be loaded onto the archery bow shot cover device 10 and to remove sounds from the archery bow shot cover device 10.

The LED light 82 illuminates when the sound select button 78 is pressed.

Each time the sound select button 78 is pressed, the light 82 blinks indicating that the sound has been changed. Preferably, in addition to or as an alternative to the light 82 blinking, the light 82 may change to a different color corresponding to an animal sound. For example, the light 82 may illuminate as a red color for a doe bleat or as a green color for an elk bugle.

The USB port 84 is coupled to the circuit board 66. The USB port 84 enables the connection of the archery bow shot cover device 10 to a computer for downloading additional sounds to the archery bow shot cover device 10, and for removing unwanted sounds from the archery bow shot cover device 10. By providing the archery bow shot cover device 10 with a direct link to a computer, an endless number and variety of sounds can be installed onto and emanated from the archery bow shot cover device 10.

The archery bow shot cover device 10 includes a power source 86. The power source 86 may be at least one battery, solar power, or any other suitable power supply. Referring to the figures, as an example, the power source 86 includes at least one battery housed within a battery compartment 90. Preferably, the battery compartment 90 is positioned within the housing 32, and is enclosed by the battery lid 38. A USB opening 92 is positioned in the battery compartment 90 for providing access for a USB cable (not shown) to connect with the USB port 84 on the circuit board 66.

Additional components of the archery bow shot cover device 10 include a bracket 94 for spacing the circuit board 66 a distance from the shell of the housing 32, and a bracket 96 for supporting the speaker 64 within the housing 32. The plurality of buttons, such as the on/off switch 76, the test switch 74, and the like, extend through apertures 98 in the button panel 36 of the housing 32 and are coupled to the circuit board 66 for enabling an operator to press the buttons and initiate a function, such as turning the device on or off, switching the type of animal sound, etc.

For the various embodiments of this invention, the same reference characters will be used to designate like parts. In addition, like functions and like interactions of the parts among the various embodiments of this invention will not be repeated for each embodiment.

Figure 7:
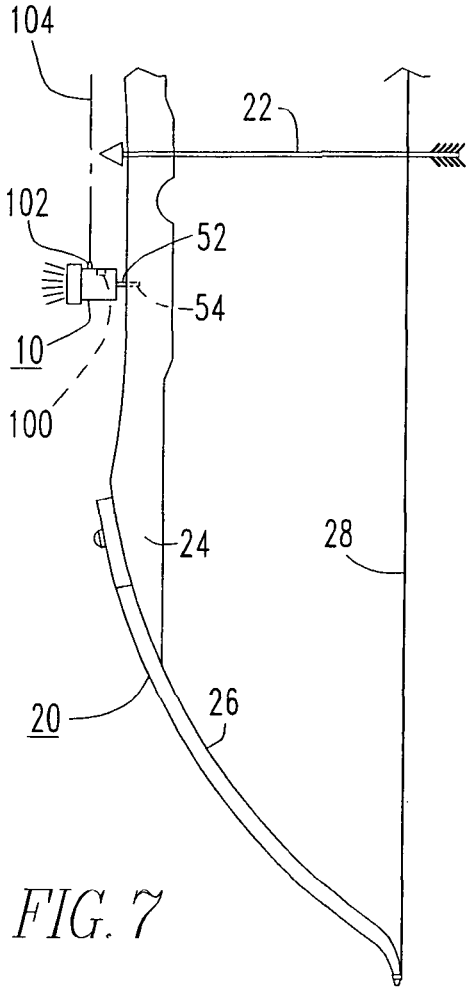
FIG. 7 is an alternative embodiment of the archery bow shot cover device.

Referring to FIG. 7 and using the same reference characters to define like parts, an alternative embodiment of the archery bow shot cover device 10 as illustrated in FIGS. 1-6 may be the archery bow shot cover device 10 having a sensor 100 in place of the sensor 56. The sensor 100 is a motion detector, such as a photo-sensor motion detector, a radar-based motion detector, a passive infrared motion detector, or any other device that detects motion. The sensor 100 sends the signal to the memory chip 62, instead of the accelerometer 60 sending the signal to the memory chip 62.

As one example, a light breaking beam device can be used as the motion detector sensor 100. A light source 102 is positioned on or in the housing 32 and emits a beam of light 104. For this embodiment, the passage of the arrow 22 through the beam of light 104 would trigger the memory chip 62 to release a sound through the speaker 64.

As another example, the sensor 56 may include a source of focused light, such 1.0 as a laser beam or other beam of light, and a light sensor. The light source is positioned in the housing 32 and emits a beam of light through an opening in the shell of the housing 32. The light sensor is positioned on the bow in close proximity to the light source for receiving the beam of light. Passage of the arrow 22 through the beam of light breaks the contact of the beam of light with the light sensor, which triggers the light sensor to send a signal to the memory chip 62 to release a sound through the speaker 64.

Figure 8:
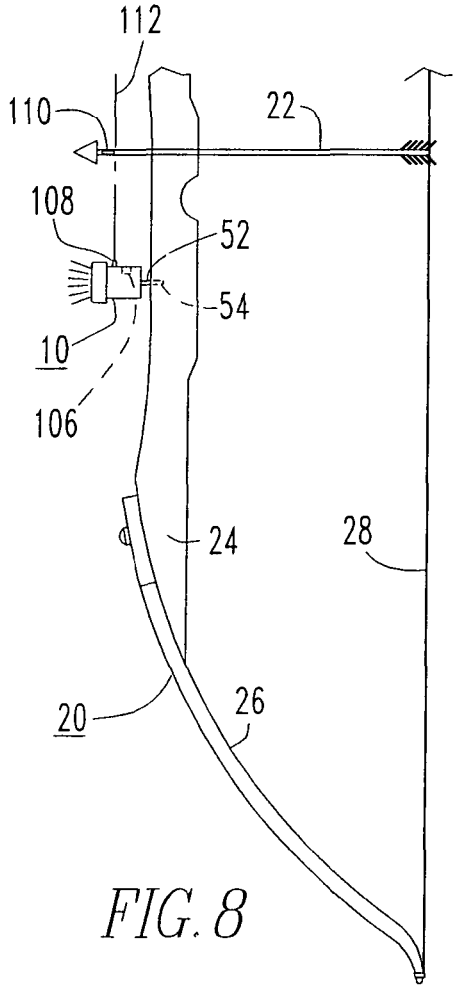
FIG. 8 is another alternative embodiment of the archery bow shot cover device.

Referring to FIG. 8, as yet another alternative, the archery bow shot cover device 10 may have a sensor 106 in place of the sensor 56. The sensor 106 may include a detector 108 that is positioned on the housing 32, and a trigger mechanism 110, such as a bar code or the like, positioned on the arrow 22. When the arrow 22 is drawn back, as the trigger mechanism or bar code 110 passes the detector 108, the archery bow shot cover device 10 is turned on. When the arrow 22 is released and passes past the detector 108 again, the detector 108 sends a signal to the memory chip 62, which releases the sound through the speaker 64. The detector 108 may emit an infrared ray 112 that contacts the bar code 110 or other trigger mechanism and activates the sensor 106.

In operation, the archery bow shot cover device 10 can be used with the pre-programmed sounds, or by connecting a cable to the USB port 84 or the jack 80, additional sounds can be installed onto the archery bow shot cover device 10. Batteries 86 are installed into the battery compartment 90, or an alternative power supply is activated. The battery lid 38 is replaced to close the batteries 86 within the battery compartment 90. The archery bow shot cover device 10 is installed onto the desired bow 20.

An operator presses the on/off switch 76 to turn the archery bow shot cover device 10 on. The operator presses the sound select button 78 until the desired sound is programmed. Each time that the sound select button 78 is pressed, the LED light 82 illuminates indicating that the sound has been changed. The operator presses the volume up or down switch 70 or 72 to adjust the volume level of the sound. The test switch 74 is pressed to insure that the device 10 is working properly.

When it is decided to release the arrow 22, such as to shoot an animal, the arrow is released in the normal manner. As the arrow 22 is released from the bow 20, the sensor 56, 60, 100, or 106 is activated, which sends a signal to release a sound from the memory chip 62. The memory chip 62 releases a signal containing the sound and the signal is sent to the speaker 64, which takes the electronic signal stored in the memory chip 62 and turns it back into an actual sound that can be heard. The sound emits from the speaker 64, covering up or camouflaging the noise of the bow 20 and arrow 22 from an animal.

For the alternative embodiment of FIG. 7, when the arrow 22 breaks the beam of light 104, the sound mechanism is activated. As the arrow 22 travels toward the animal, a sound is produced by the archery bow shot cover device 10 for covering up the noise produced by the bow during release of the arrow 22.

For the alternative embodiment of FIG. 8, when the arrow 22 is drawn back, the bar code 110 positioned on the arrow 22 turns on the device 10 as the bar code 110 passes the detector 108 positioned on the housing 32. As the bar code 110 of the arrow 22 passes the detector 108 a second time, the motion detector 108 triggers the sound to be released through the speaker 64.

Advantages of the archery bow shot cover device 10 are that the animal is less likely to be startled by the natural animal sound produced by the archery bow shot cover device 10, than by the vibrating thud or slapping noise produced by the bow during release of the arrow. If the animal is not startled, it is more likely to remain in the position that it was in when the arrow was shot, increasing the percentage of a good hit which kills the animal and not just injures the animal.

Another advantage is that the housing 32 can be removed from the archery bow 20 during practice or for storage.

Yet another advantage of the archery bow shot cover device 10 is the inclusion of a memory chip 62 for storing multiple sounds, such as different types of animal sounds or other natural sounds. Additionally, the use of a USB port 84 or jack 80 coupled to the memory chip 62 enables the downloading of additional sounds from a computer or other source.

Another advantage of the archery bow device 10 is that the device 10 includes a sound select button 78 and a light 82. Activation of the sound select button 78 scrolls through the different sounds stored in the memory chip 62 and illumination of the light 82 visually enables a person to view the alteration of the sounds.

Another advantage is that various types of sensors can be used for triggering the sound mechanism, such as either sensors for detecting vibration, motion, breaking of a beam of light, or the like.

Thus there has been shown and described a novel archery bow shot cover device which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. An archery device for attachment to an archery bow having an arrow, comprising:

an electronic sensor positionable on the archery bow, the electronic sensor electronically detecting a release of the arrow from the archery bow and the release of the arrow activating the electronic sensor for producing a signal; and a sound mechanism coupled to the sensor for producing at least one sound, the sound mechanism activated when the signal is received from the electronic sensor and emitting the at least one sound when the arrow is released from the archery bow for covering up noise emanating from the archery bow when the arrow is released therefrom.

2. The archery device according to claim 1, further comprising a housing attachable to the archery bow, and having the sensor and sound mechanism positioned within the housing.

3. The archery device according to claim 2, further comprising a USB port positioned in the housing for transferring sounds from a remote location to the sound mechanism.

4. The archery device according to claim 2, further comprising a plurality of buttons positioned on the housing and coupled to the sound mechanism for controlling operation of the archery device.

5. The archery device according to claim 1, wherein the sound mechanism comprises a speaker for emanating one of the at least one sound therefrom.

6. The archery device according to claim 1, wherein the sound mechanism comprises a memory chip coupled to the sensor for storing the at least one sound in the archery device.

7. The archery device according to claim 1, wherein the sensor is an accelerometer.

8. The archery device according to claim 1, wherein the sensor is a motion detector.

9. The archery device according to claim 1, wherein the sensor includes a beam of light, breaking of the beam of light by the arrow activating the sound mechanism.

10. The archery device according to claim 1, further comprising an LED light electrically coupled to the sound mechanism, the LED light illuminating light upon activation for indicating a modification in a type of sound to be produced by the sound mechanism.

11. The archery device according to claim 1, further comprising a sound select button coupled to the sound mechanism for scrolling through the at least one sound to select a desired sound.

12. An archery bow shot cover device for attachment to an archery bow having an arrow, comprising:

a housing attachable to the archery bow;

a sensor positioned within the housing and positioned to detect that the arrow was released from the archery bow, the sensor producing a signal when the arrow is released from the archery bow; and a sound mechanism coupled to the sensor for detecting the signal received from the sensor and for producing at least one sound, the sound mechanism activated by the signal received from the sensor for producing the at least one sound when the arrow is shot released from the archery bow for covering up noise emanating from the archery bow when the arrow is shot released therefrom.

13. The archery bow shot cover device according to claim 12, wherein the sound mechanism includes:

a memory chip, capable of storing the at least one sound, positioned within the housing and connected to the sensor for receiving a signal from the sensor to release one of the at least one sound from the memory chip; and a speaker attached to the housing and coupled to the memory chip for receiving the at least one sound from the memory chip, the memory chip activated by the sensor for producing the at least one sound when the arrow is shot from the archery bow for covering up noise emanating from the archery bow when the arrow is shot therefrom.

14. The archery device according to claim 12, further comprising a USB port positioned in the housing for transferring sounds from a remote location to the sound mechanism.

15. An archery bow shot cover device for attachment to an archery bow having an arrow, comprising:

a housing attachable to the archery bow;

a vibration sensor positioned within the housing, the vibration sensor positioned to detect a release of the arrow from the archery bow;

a memory chip, capable of storing at least one animal sound, positioned within the housing and coupled to the vibration sensor; and a speaker attached to the housing and coupled to the memory chip, the memory chip activated when vibration is detected by the vibration sensor for producing the at least one sound when an arrow is released from the archery bow for covering up noise emanating from the archery bow when the arrow is released therefrom.

16. The archery bow shot cover device according to claim 15, wherein the vibration sensor is an accelerometer.

17. The archery bow shot cover device according to claim 15, further comprising a USB port positioned in the housing for transferring the at least one sound to the memory chip.

18. The archery bow shot cover device according to claim 15, further comprising:

a sound select button positioned on the housing and coupled to the memory chip; and a LED light coupled to the sound select button and to the memory chip, the LED light capable of eliminating light upon activation of the sound select button for indicating a modification in the type of sound to be emanated from the speaker, the LED light changing colors depending on the at least one sound selected for providing an indication of a specific sound to be emitted from the speaker.

19. The archery bow shot cover device according to claim 15, further comprising a power source for supplying power to the archery bow shot cover device.

20. The archery bow shot cover device according to claim 15, further comprising:

a volume increase switch coupled to the speaker for increasing the volume of the at least one sound;

a volume decrease switch coupled to the speaker for decreasing the volume of the at least one sound;

a test switch coupled to the memory chip for testing and monitoring various functions of the archery bow shot cover device; and an on/off switch coupled to the memory chip and to the speaker for turning the archery bow shot cover device on and off.

* * * * *